US009664449B2

(12) United States Patent
Kinder et al.

(10) Patent No.: US 9,664,449 B2
(45) Date of Patent: May 30, 2017

(54) SYSTEM WITH HEAT EXCHANGER WITH SIDE ENTRY FITTING

(75) Inventors: Lee M. Kinder, Oakville (CA); Nikolas Stewart, Halton Hills (CA); Doug Waller, Burlington (CA)

(73) Assignee: Dana Canada Corporation, Oakville, Ontario (CA)

( * ) Notice: Subject to any disclaimer, the term of this patent is extended or adjusted under 35 U.S.C. 154(b) by 539 days.

(21) Appl. No.: 13/562,842

(22) Filed: Jul. 31, 2012

(65) Prior Publication Data

US 2013/0032319 A1 Feb. 7, 2013

Related U.S. Application Data

(60) Provisional application No. 61/515,388, filed on Aug. 5, 2011.

(51) Int. Cl.

| | |
|---|---|
| ***F28F 3/08*** | (2006.01) |
| ***F28F 3/14*** | (2006.01) |
| ***F28D 7/06*** | (2006.01) |
| ***F28F 9/04*** | (2006.01) |
| ***F16L 37/00*** | (2006.01) |
| ***F16L 21/00*** | (2006.01) |
| ***F28D 1/03*** | (2006.01) |
| *F28F 9/02* | (2006.01) |

(52) U.S. Cl.

CPC ..... *F28D 1/0341* (2013.01); *F28F 9/0246* (2013.01); *F28F 9/0253* (2013.01); *F28D 1/03* (2013.01); *F28F 9/0248* (2013.01); *F28F 9/0251* (2013.01)

(58) Field of Classification Search

CPC ..... F28D 1/03; F28D 1/0341; F28F 9/0251; F28F 9/0248; F28F 9/0253; F28F 9/0246

USPC ..... 165/176, 178, 170; 285/305, 399

See application file for complete search history.

(56) References Cited

U.S. PATENT DOCUMENTS

| | | | |
|---|---|---|---|
| 872,332 A | 12/1907 | Dreier | |
| 1,085,889 A | 2/1914 | Carl | |
| 2,612,284 A | 9/1952 | Snyder | |

(Continued)

FOREIGN PATENT DOCUMENTS

| | | | |
|---|---|---|---|
| CA | 2520238 A1 | 3/2007 | |
| JP | 2704754 B2 * | 1/1998 | ..... F02B 61/045 |

(Continued)

OTHER PUBLICATIONS

Translation of Japanese Document JP 2006000280A named TRANS-JP 2006000280A.*

(Continued)

*Primary Examiner* — Justin Jonaitis

*Assistant Examiner* — Paul Alvare

(74) *Attorney, Agent, or Firm* — Marshall & Melhorn, LLC

(57) ABSTRACT

A heat exchanger system containing a heat exchanger coupled to a fitting. The fitting contains a tube having a heat exchanger attachment end and an opposing end. The fitting further having a sleeve, having a sleeve body connecting a first end of the sleeve to an overlapping end. The first end of the sleeve being coupled to an outer surface of the tube and the sleeve body and the second end of the sleeve being spaced from the outer surface of the tube defining a space for receiving a conduit and adapted for coupling the fitting to the conduit. Also described is a fitting that can be attached to a conduit.

7 Claims, 12 Drawing Sheets

(56) References Cited

U.S. PATENT DOCUMENTS

| | | | | | |
|---|---|---|---|---|---|
| 4,258,785 | A * | 3/1981 | Beldam | F28D 1/0333 165/153 |
| 5,078,209 | A * | 1/1992 | Kerkman | F28D 9/0012 165/167 |
| 5,355,947 | A * | 10/1994 | Rasso et al. | 165/176 |
| 5,450,896 | A | 9/1995 | Bertva | |
| 5,555,929 | A * | 9/1996 | Ishikawa | 165/76 |
| 5,816,316 | A | 10/1998 | Hoffnung | |
| 5,816,321 | A | 10/1998 | Wijkstrom | |
| 5,988,270 | A | 11/1999 | Chevallier | |
| 6,520,251 | B2 * | 2/2003 | Shin et al. | 165/153 |
| 2003/0079871 | A1 * | 5/2003 | Samy et al. | 165/174 |
| 2003/0214130 | A1 | 11/2003 | Schroeder et al. | |
| 2006/0244255 | A1 | 11/2006 | Coscarella | |
| 2010/0077794 | A1 * | 4/2010 | Higashiyama | F25B 39/022 62/515 |

FOREIGN PATENT DOCUMENTS

| | | | |
|---|---|---|---|
| JP | 2006000280 | | 1/2006 |
| JP | 2006000280 | A * | 1/2006 |

OTHER PUBLICATIONS

Translation of Japanese Patent Document JP 2704754 B2 named JP 2704754 B2-Translation.*

* cited by examiner

SYSTEM WITH HEAT EXCHANGER WITH SIDE ENTRY FITTING

RELATED APPLICATIONS

This application claims benefit of and priority to U.S. Provisional Application Ser. No. 61/515,388 filed on Aug. 5, 2011, which is incorporated by reference in its entirety.

FIELD

The specification relates to a side-entry fitting, a heat exchanger system having a heat exchanger coupled to the fitting and a method for installing the side entry fitting to a heat exchanger.

BACKGROUND

During brazing for manufacturing a clamshell heat exchanger, the weight of the fittings and the liquid clad layer created can cause the fittings to sag and slide out of the clamshell. In other cases, where the fitting and the clamshell heat exchanger are brazed, the two plates of the heat exchanger need to be held together to assist in brazing the fitting and the clamshell heat exchanger.

In addition, where the clamshell plates meet there is a gap (as shown in FIG. 21) created by the stamping process that can also lead to leakage between the clamshell heat exchanger and the fitting.

To address the leakage from the gap created during the stamping process, a flux paste or a braze ring is used and the gap can be sealed by brazing. However, insufficient flux paste or improper placement of the braze ring can result in leakage from the gap in the clamshell heat exchanger where the fitting is attached.

Therefore, there is a need in the art for a fitting that can be attached to a heat exchanger that can resist in sagging and inhibit vertical movement of the fitting, i.e. movement which is normal to the longitudinal axis of the fitting, while permitting axial movement. Further, there is a need in the art that can assist in retaining the braze ring to the heat exchanger. Moreover, there is a need in the art for a fitting that can be used to hold together the plates of a clamshell heat exchanger while brazing the heat exchanger and the fitting.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

SUMMARY OF THE INVENTION

Figure 1:
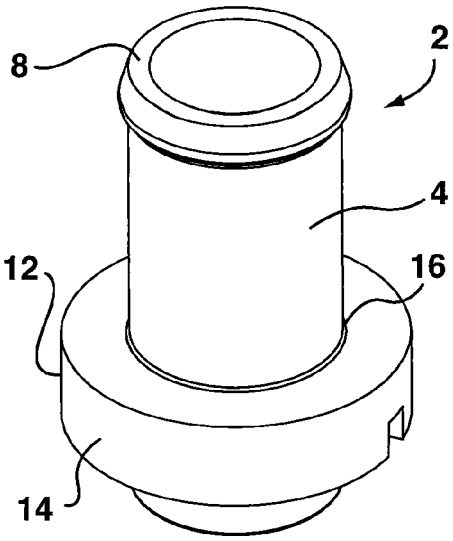
FIG. 1 shows a perspective view of an embodiment according to one aspect of the invention.
Figure 3:
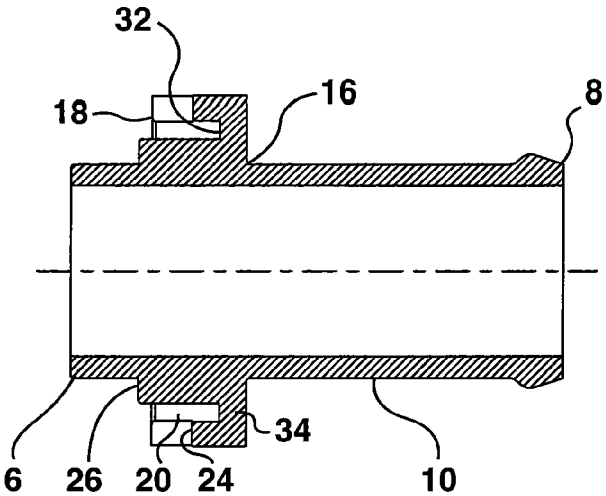
FIG. 3 shows a sectional view along the line A-A of the FIG. 2.
Figure 2:
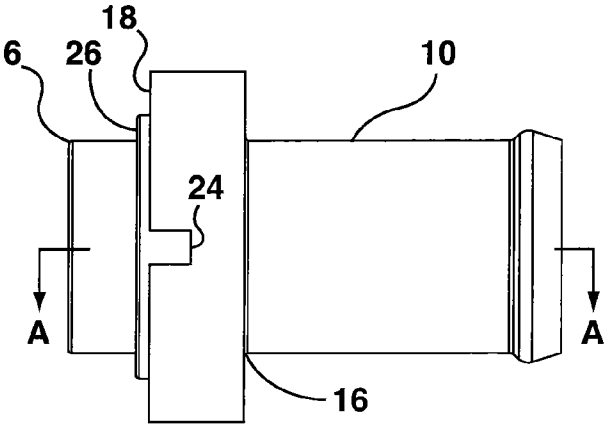
FIG. 2 shows a side view of the embodiment according to one aspect of the invention.
Figure 5:
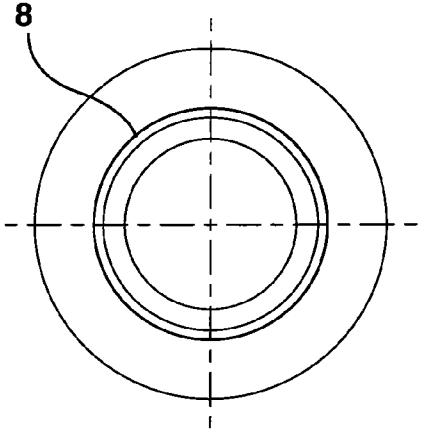
FIG. 5 shows a back end view of the embodiment according to one aspect of the invention.
Figure 4:
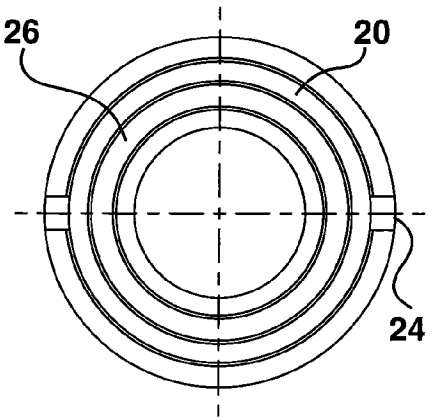
FIG. 4 shows a front end view of the embodiment according to one aspect of the invention.
Figure 6:
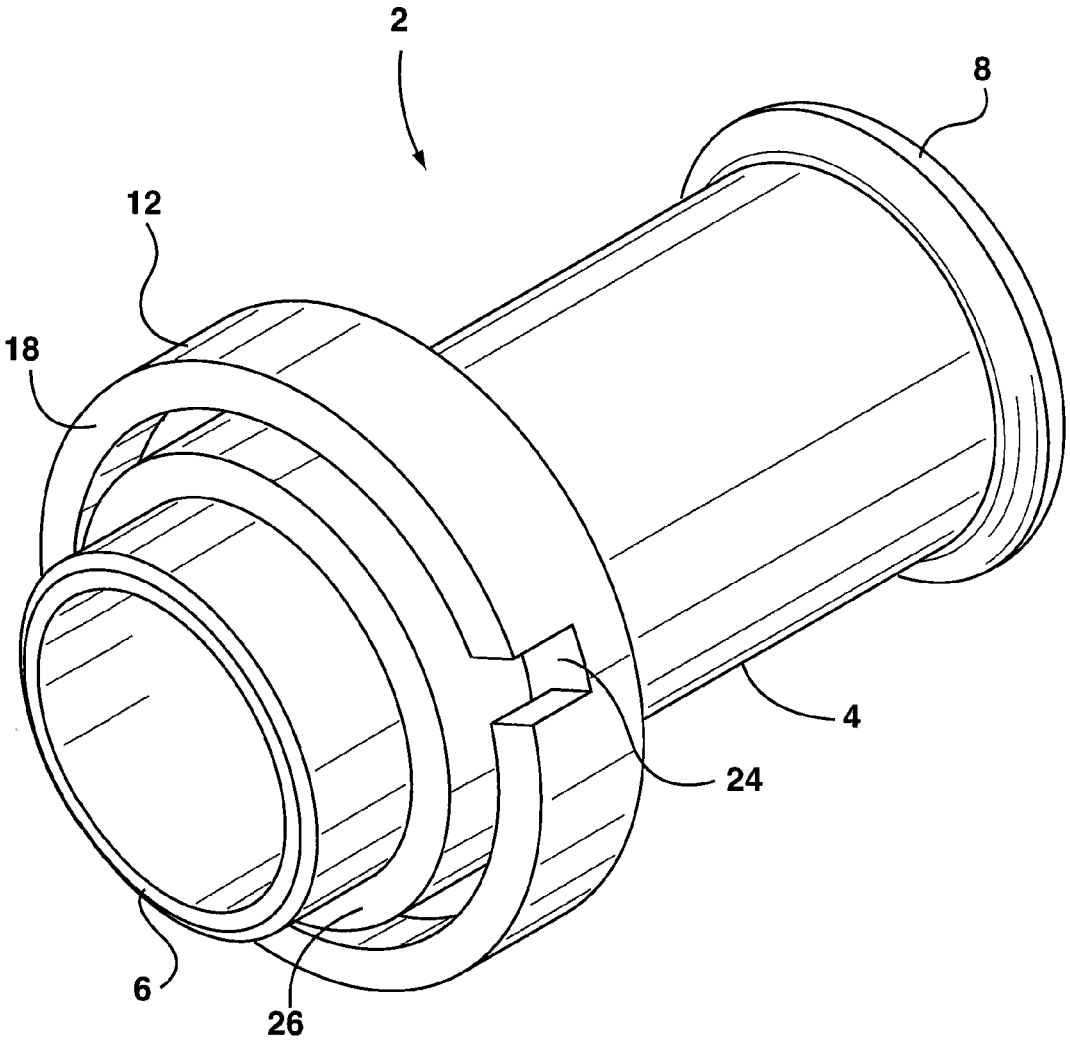
FIG. 6 shows a perspective view of the embodiment according to one aspect of the invention.
Figure 7:
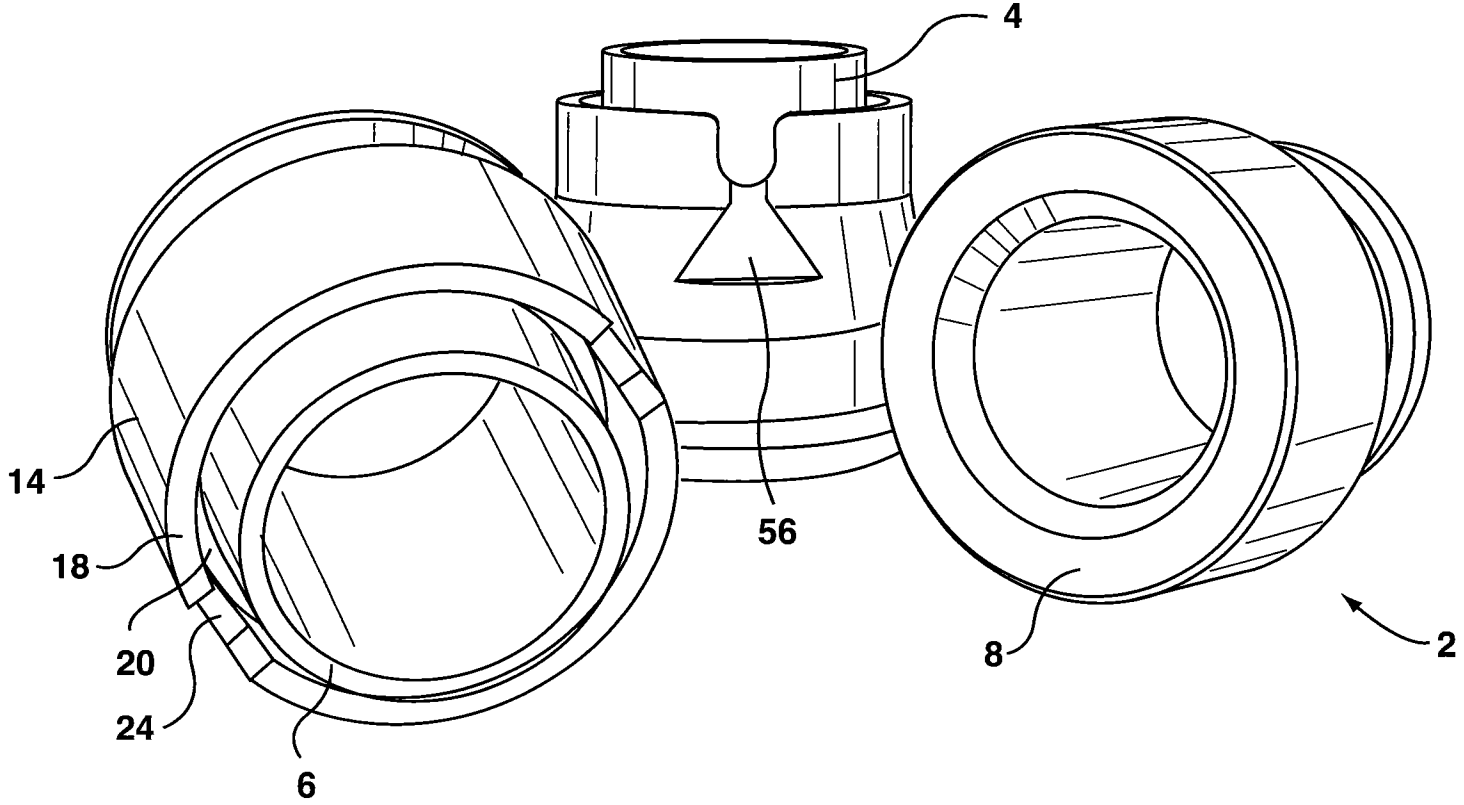
FIG. 7 shows a fittings according to a further aspect of the specification.
Figure 10:
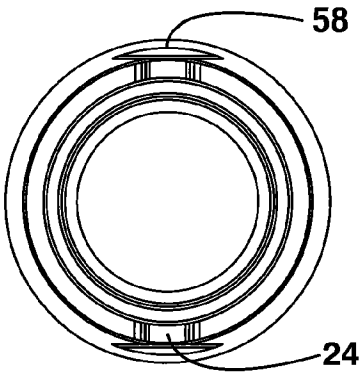
FIG. 10 shows a front end view of a fitting according to a further aspect of the specification.
Figure 9:
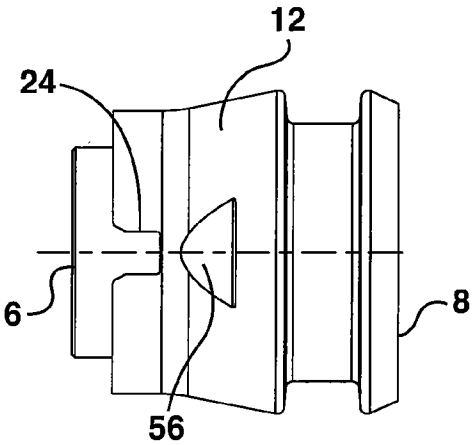
FIG. 9 shows a side view of a fitting according to a further aspect of the specification.
Figure 12:
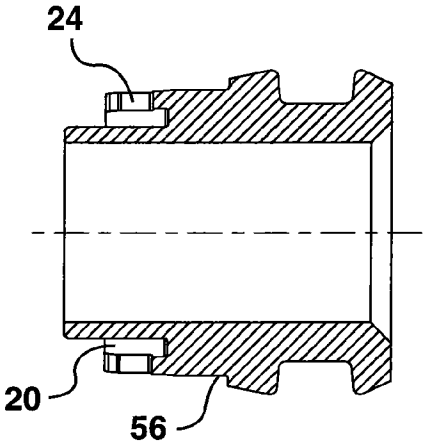
FIG. 12 shows a cross-sectional view along the line B-B of FIG. 11.
Figure 8:
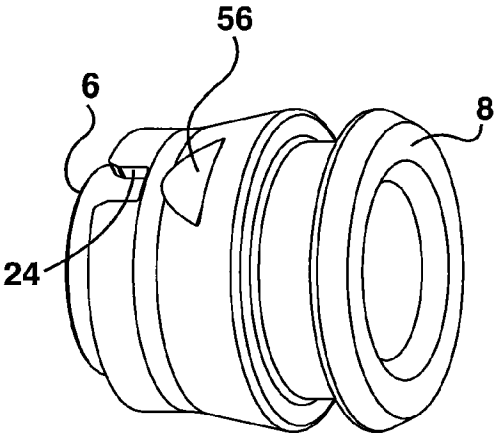
FIG. 8 shows another perspective view of fittings according to a further aspect of the specification.
Figure 11:
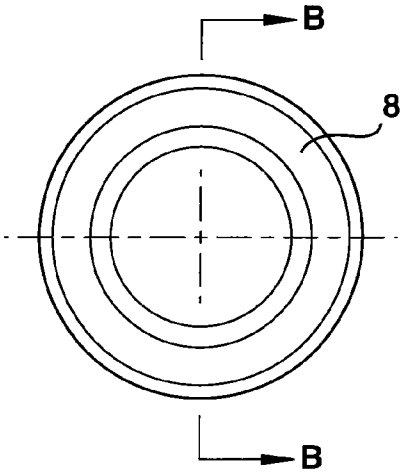
FIG. 11 shows a back end view of a fitting according to a further aspect of the specification.
Figure 13:
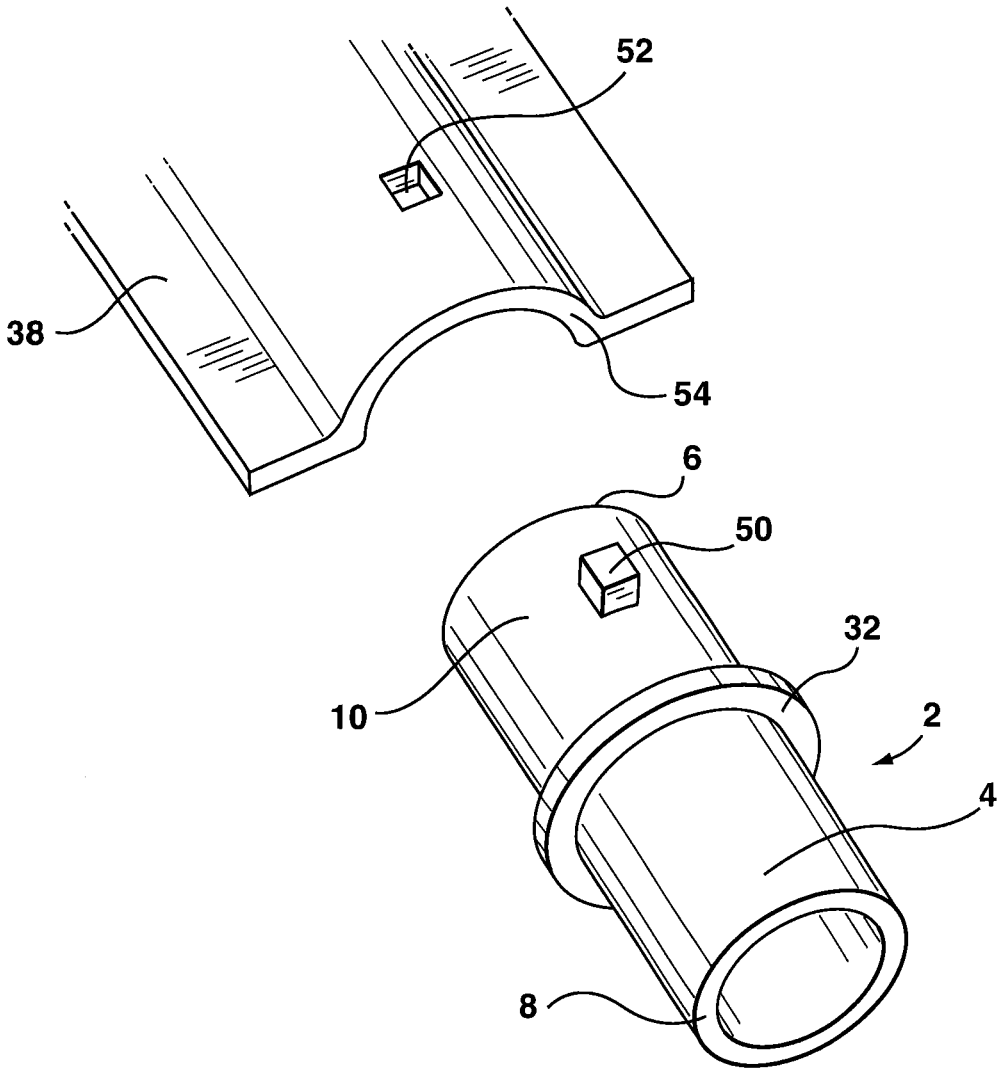
FIG. 13 shows a perspective view of a fitting attachable to a plate of a heat exchanger according to another aspect of the invention.
Figure 16:
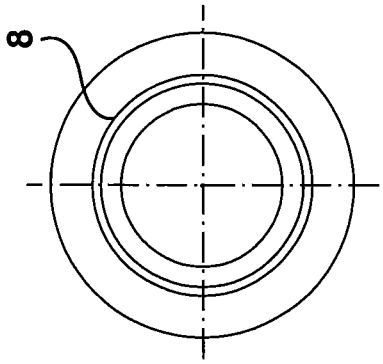
FIG. 16 shows a back end view of a fitting according to another aspect of the invention.
Figure 15:
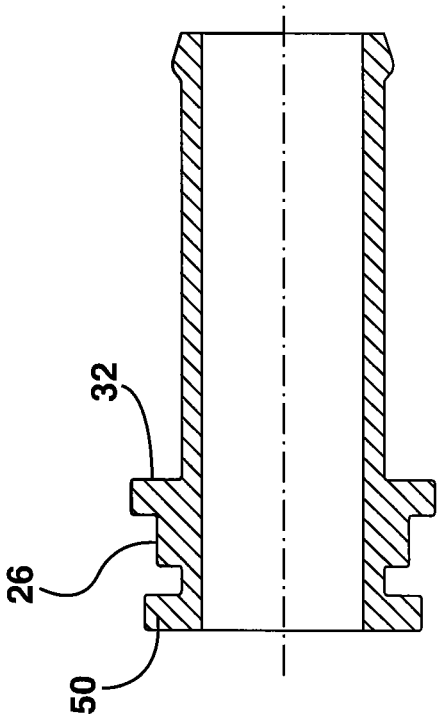
FIG. 15 shows a sectional view along the line C-C of FIG. 14 of a fitting according to another aspect of the invention.
Figure 14:
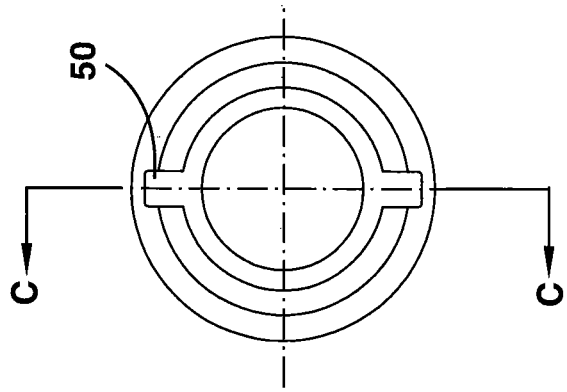
FIG. 14 shows a front end view of a fitting according to another aspect of the invention.

In one aspect, the specification discloses a fitting containing:

- a tube having a heat exchanger attachment end and an opposing end; and
- a sleeve having a sleeve body connecting a first end to the second end of the sleeve, the first end of the sleeve being connected to an outer surface of the tube, and the sleeve body and the second end of the sleeve extending in a direction of the heat exchanger attachment end of the tube and being spaced apart from the outer surface of the tube defining a space for receiving a conduit and adapted for coupling the fitting to the conduit.

In another aspect, the specification discloses a fitting containing:

- a tube having a heat exchanger attachment end and an opposing end;
- a stop positioned on an outer surface of the tube; and
- a tab on the outer surface of the tube positioned proximate to the heat exchanger attachment end and intermediate the heat exchanger attachment end and the stop, the tab adapted for engaging an aperture in a conduit for coupling the fitting to the conduit.

In a further aspect, the specification discloses a heat exchanger system containing:

- a heat exchanger having a spaced-apart plate pair, each plate of the plate pair having an indentation extending from a surface of the plate to an end of the plate for forming a conduit when the plates of the plate pair are positioned in a face-to-face relationship; and a fitting containing:

a tube having a heat exchanger attachment end and an opposing end; and a sleeve having a sleeve body connecting a first end to the second end of the sleeve, the first end of the sleeve being connected to an outer surface of the tube, and the sleeve body and the second end of the sleeve extending in a direction of the heat exchanger attachment end of the tube and being spaced apart from the outer surface of the tube defining a space for receiving the conduit and adapted for coupling the fitting to the conduit.

In a still further aspect, the specification discloses a heat exchanger system containing:

a heat exchanger having a spaced-apart plate pair, each plate of the plate pair having an indentation extending from a surface of the plate to an end of the plate for forming a conduit when the plates of the plate pair are positioned in a face-to-face relationship; and a fitting containing:

a tube having a heat exchanger attachment end and an opposing end;

a stop positioned on an outer surface of the tube; and a tab on the outer surface of the tube positioned proximate to the heat exchanger attachment end and intermediate the heat exchanger attachment end and the stop, the tab adapted for engaging an aperture in the conduit for coupling the fitting to the conduit.

DESCRIPTION

As disclosed above, the specification discloses a fitting (2) as shown in FIGS. 1-6. The fitting (2) contains:

a tube (4) having a heat exchanger attachment end (6) and an opposing end (8); and a sleeve (12) having a sleeve body (14) connecting a first end (16) to a second end (18) of the sleeve (12), the first end (16) of the sleeve (12) being connected to an outer surface (10) of the tube (4), and the sleeve body (14) and the second end (18) of the sleeve (12) extending in a direction of the heat exchanger attachment end (6) of the tube (4) and being spaced apart from the outer surface (10) of the tube (4) defining a space (20) for receiving a conduit (22) and adapted for coupling the fitting (2) to the conduit (22).

FIGS. 1-6 show a first embodiment of a fitting (2) that is made up of a tube (4) and a sleeve (12) attached to the tube (4). The tube (4) at one end, designated as the heat exchanger attachment end (6), is designed for coupling to a conduit (22) of a heat exchanger (38). While the opposing end (8) of the tube (4) can be designed for attachment to, for example and without limitation, a pipe (not shown) containing fluid flowing through it. Typically, the heat exchanger attachment end (6) of the tube (4) is inserted into an opening (60) in the conduit(22) of the heat exchanger (38). The opening (60) can provide an inlet or outlet for flow of a fluid within the heat exchanger (38). As shown in the Figures, the heat exchanger is made up of spaced-apart plate pairs that provide a passage for flow of fluid for heat exchange. One part of the plate pairs is manufactured to provide the inlet and/or outlet opening (60). In such a plate pair, each plate of the plate pair has an indentation that extends from a surface of the plate to an end of the plate to form a conduit when the plates of the plate pair are positioned in a face-to-face relationship. As shown in the Figures, the edge of the conduit (defining the opening) is flush with the end of the plate pair and does not extend beyond the end (or edge) of the plate pair. In other words, the indentation forming the conduit has an edge that lies in the same plane as the end of the plate pair.

Although the tube (4) shown in the figures has a circular or cylindrical shape, the shape and dimensions of the tube (4) are not particularly limited and can depend upon the particular design and application requirements. It would be recognized that the shape of the tube (4) should be complementary to the opening (56) in the conduit (22), to allow coupling of the fitting (2) to the conduit (22).

Attached to the outer surface (10) of the tube (4) is a sleeve (12) that extends from the outer surface (10) of the tube (4) towards the heat exchanger attachment end (6). The sleeve (12) is made up of a sleeve body (14) being at one end, designated as the first end (16) of the sleeve (12), attached or connected to the outer surface (10) of the tube (4). While the second end (18) of the sleeve (12) is positioned closer to the heat exchanger attachment end (6) of the tube (4) than the first end (16) of the sleeve (12).

The extension of the sleeve body (14) and position of the second end (18) of the sleeve (12) relative to the heat exchanger attachment end (6) of the tube (4) is not particularly limited and can depend upon design and application requirements. In one embodiment, for example and without limitation, the sleeve body (14) extends to the same length or nearly the same length to the heat exchanger attachment end (6) of the tube (4), such that the second end (18) of the sleeve (12) lies adjacent to the heat exchanger attachment end (6). In another embodiment, the second end (18) of the sleeve (12) can lie in between the heat exchanger attachment end (6) and the first end (16) of the sleeve (12). In a still further embodiment, and as shown in FIGS. 1-6, the second end (18) of the sleeve (12) is positioned proximate to the first end (16) of the sleeve (12). The position can vary so long as the sleeve body (14) can provide sufficient surface area for coupling to the conduit (22), as described herein.

The sleeve body (14) and the second end (18) of the sleeve (12) are spaced-apart from the outer surface (10) of the tube (4) to provide a space (20) for receiving a conduit (22), for example the conduit (22) of a heat exchanger (38). The fitting (2) is designed to allow for insertion of the heat exchanger attachment end (6) of the tube (4) into the conduit (22). While the second end (18) of the sleeve (12) and at least a portion of the sleeve body (14) overlaps the conduit (22), such that a portion of the conduit (22) is sandwiched between the outer surface (10) of the tube (4) and a portion of the sleeve body (14).

The attachment of the sleeve body (14) at the first end (16) to the outer surface (10) of the tube (4) also provides a stop (32) to limit the extent the heat exchanger end (6) can be inserted into the conduit (22). Alternatively, although not shown, a stop (32) can also be provided within the space (20) separating the sleeve body (14) from the outer surface (10) of the tube (4), so long as sufficient surface area is provided for coupling the sleeve body (14) to the conduit (22). In the embodiment shown in the figures, the stop (32) is provided by a wall (34) extending from the first end (16) of the sleeve (12). The shape of the stop (32) or wall (34) is not particularly limited. In one embodiment, the wall (34) is normal to the outer surface (10) of the tube (4) and can contact the outer surface of the conduit (22) for brazing the wall (34) to the outer edge of the plate (46) forming the conduit (22).

The shape of the sleeve (12) is not particularly limited so long as it is sufficiently complementary to the shape of the conduit (22) to allow for coupling of the sleeve (12) with the conduit (22). In the embodiments shown, the cross-section of the sleeve (12) is circular, being similar to the cross-section of the tube (4), however, other shapes are also possible depending upon the design and application requirements.

In one embodiment, the fitting (2) further contains a notch (24) at the second end (18) of the sleeve (12). The notch (24) is adapted for receiving edges of the plates (46) of the heat exchanger. The presence of the notch (24) can further help in holding the plates (46) of the heat exchanger together, including during the brazing process. Moreover, the fitting (2) along with the overlapping sleeve (12) can also help to block the leakage from a gap (48) when the two plates of the heat exchanger are placed in a face-to-face relationship.

In a further embodiment, the fitting (2) can further contain a step (26) on the outer surface (10) of the tube in the space (20) between the sleeve body (14) and the outer surface (10) of the tube. The presence of the step (26) between the outer surface (10) of the tube and the sleeve body (14) helps to provide a track for receiving the conduit (22). The track provided by the step (26) can help to ensure that the conduit (22) is properly positioned in the space (20) between the outer surface (10) of the tube (4) and the sleeve body (14). The presence of the track can further assist in keeping the fitting (2) from sagging and can also only allow the fitting (2) to move axially, while holding the plates together securely while brazing.

The shape of the step (26) provided is not particularly limited and can depend upon the particular design and application requirements. In the embodiment disclosed in FIGS. 1-6, the step (26) encircles the tube (4). However, for example, multiple projecting tabs (not shown) can be provided that are positioned in a single plane normal to the outer surface (10) of the tube (4) to provide a similar function as the step (26) disclosed. In addition, multiple steps (26) can also be provided depending upon the design and application requirements.

FIGS. 7-12 disclose a further embodiment of a fitting (2) in accordance with the specification. The fitting (2) disclosed has a shorter tube (4) than that disclosed in FIGS. 1-6. The reduction in length of the tube (4) can help to reduce the overall weight of the fitting (2), which can help to prevent sagging of the fitting (2) when coupled to a heat exchanger (38). Further, the fitting (2) has similar features, such as, the sleeve (12) providing the space (20) for receiving the conduit (22), and notches (24) for receiving the outer edges of the plate (46), as disclosed herein.

In addition, the fitting (2) disclosed in FIGS. 7-12 is provided with a cut-out (56) on the outer surface of the sleeve body (14). The cut-out (56) can help with alignment of the notches (24) on the fitting (2) with the outer edges of the plates (46) of the heat exchanger (38). In the embodiment disclosed, the cut-out (56) is a wedge shaped cut-out, but other shapes can also be provided depending application requirements. Further, the shape of the cut-out (56), such as the wedge shown in FIGS. 7-12, can be used with different alignment means, to ensure proper alignment of the fitting (2) with the heat exchanger (38).

In another aspect, the specification discloses a fitting (2) (shown in FIGS. 13-16) containing:

- a tube (4) having a heat exchanger attachment end (6) and an opposing end (8);
- a stop (32) positioned on an outer surface (10) of the tube (4); and
- a tab (50) on the outer surface (10) of the tube (4) positioned proximate to the heat exchanger attachment end (6) and intermediate the heat exchanger attachment end (6) and the stop (32), the tab (50) adapted for engaging an aperture (52) in a conduit (22) for coupling the fitting (2) to the conduit (22).

In the embodiment disclosed in FIGS. 13-16, a stop (32) is provided. The stop (32) limits the extent to which the heat exchanger end (6) of the tube (4) is inserted into the conduit (22) and also provides a surface for contacting the outer edge of the plates (46) forming the conduit (54). In the embodiment disclosed in FIGS. 13-16, the stop (32) extends from the outer surface (10) of the tube (4), extending in a direction normal to the outer surface (10) of the tube (4) and encircles the tube (4) to ensure that the entire surface of the stop (32) that faces the conduit (22) is in contact with the outer edge of the conduit (54) or the edges of the plates (46). This can help to prevent leakage of the fluids from the conduit. In addition, the contact between the stop (32) and the outer edge of plate (46) forming the conduit (54) can provide a contact surface for assisting in brazing the conduit (22) to the fitting (2).

The fitting disclosed in FIGS. 13-16 is also provided with a tab (50) on the outer surface (10) of the tube (4). The tab (50) can be inserted into an aperture (52) in the conduit (22) for coupling the fitting (2) to the conduit (22). In addition, the presence of a tab (50) can help to prevent sagging of the fitting (2) from the plates (40) of a heat exchanger (38). The shape and dimension of the tab (50) is not particularly limited and can vary depending upon the design and application requirements, so long as it is sufficiently complementary to the aperture (52) to engage the aperture and assist with holding the fitting (2) in place in the conduit (22). In one embodiment, as shown in FIGS. 13-16, the tab (50) has a square shape.

The position of the tab (50) is also not particularly limited so long as it is positioned proximate to the heat exchanger attachment end (6) and intermediate the heat exchanger attachment end (6) and the stop (32), and can engage the aperture (52) in the conduit (22). In the embodiment disclosed in FIG. 13, the tab (50) is positioned intermediate the heat exchanger attachment end (6) and the stop (32), while in the embodiment disclosed in FIGS. 14-16, the tab (50) is positioned along the edge of the tube (4) near the heat exchanger attachment end (6).

In addition, a step (26) to define a track for insertion of the tube (4) in to the conduit (22) can also be provided. The step (26) is as disclosed and described herein above with relation to the embodiments disclosed in FIGS. 1-12.

Figure 17:
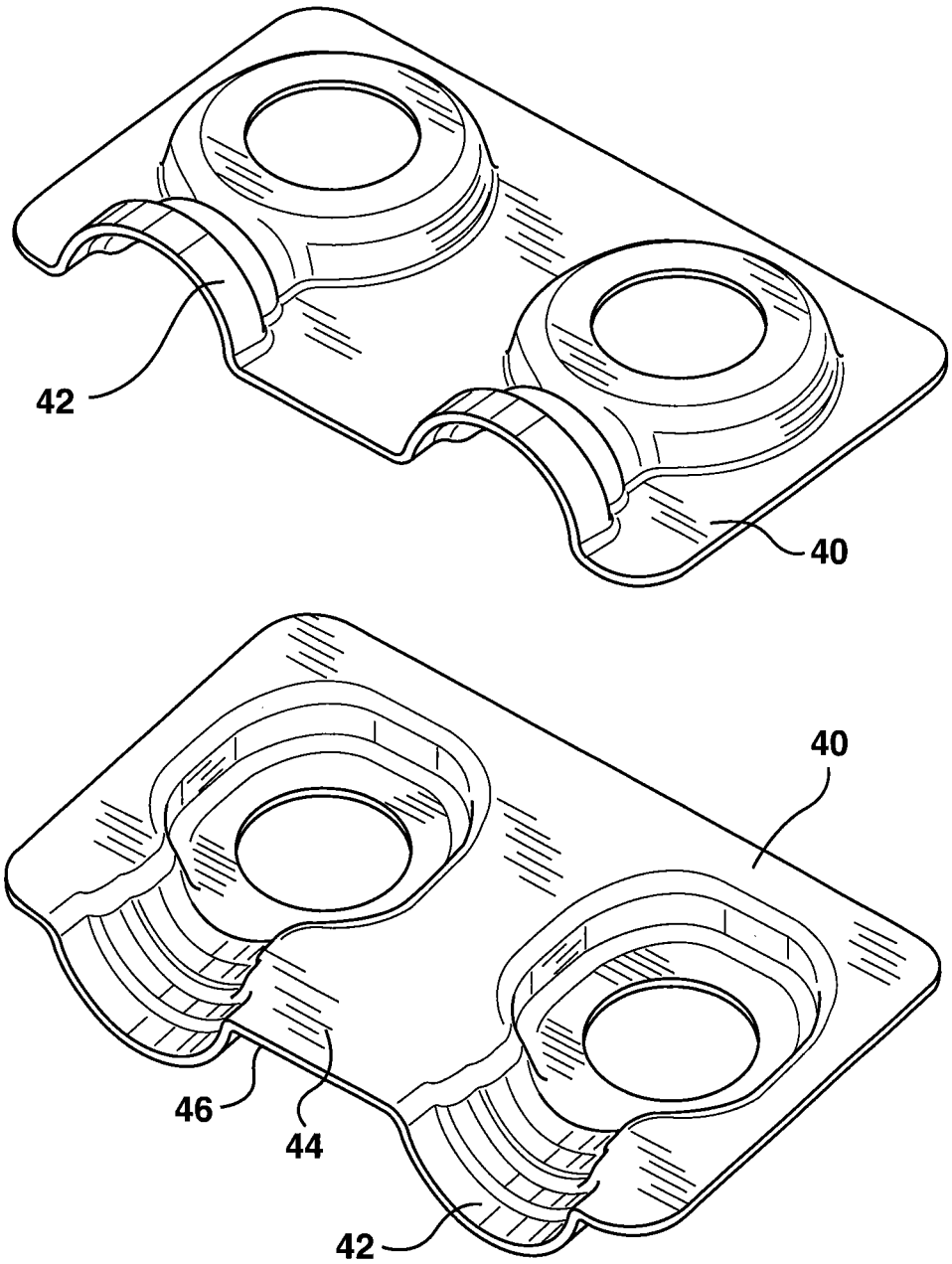
FIG. 17 shows a perspective view of a portion of each of the plates of a plate pair separated from each other.

In a further aspect, the specification discloses a heat exchanger system (36). FIGS. 17-20 show a portion of the heat exchanger (38) that permits coupling to the fitting (2). As noted above, the heat exchanger (38) is formed by spaced-apart plate pairs (40). Each plate pair (40) is formed by plates that when positioned in face-to-face relationship provides a passageway for fluid flow. FIG. 17 shows a portion of a heat exchanger system (36), where the tube (4) engages the heat exchanger (38) for coupling the fitting (2) to the heat exchanger (38). In one embodiment, the heat exchanger attachment end (6) of a single tube (4) is inserted into the conduit (22) present at a side-entry of a clamshell heat exchanger (38). Upon insertion of the tube (4), the second end (18) of the sleeve (12) and the sleeve body (14) overlaps an outer end of the conduit (22). The presence of the second end (18) of the sleeve (12) and the sleeve body (14) helps to keep the fitting (2) in place in the conduit (22), while assisting in holding the clamshell plates together during assembly. In addition, the second end (18) of the sleeve (12) and the sleeve body (14) hinders the fitting (2)

from sagging during the brazing process, while allowing the fitting (2) to move along its axis and preventing its movement normal to the axis of the fitting (2).

Figure 20:
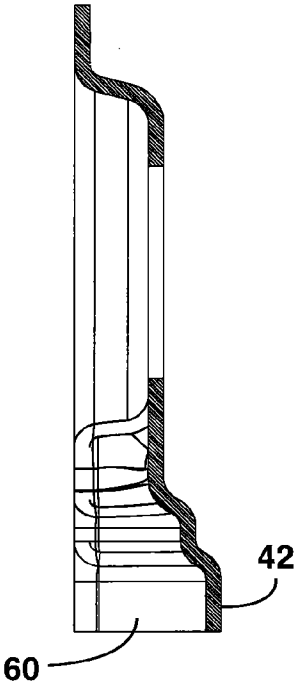
FIG. 20 shows a sectional view of a portion of a plate of a clamshell heat exchanger having side entry.
Figure 18:
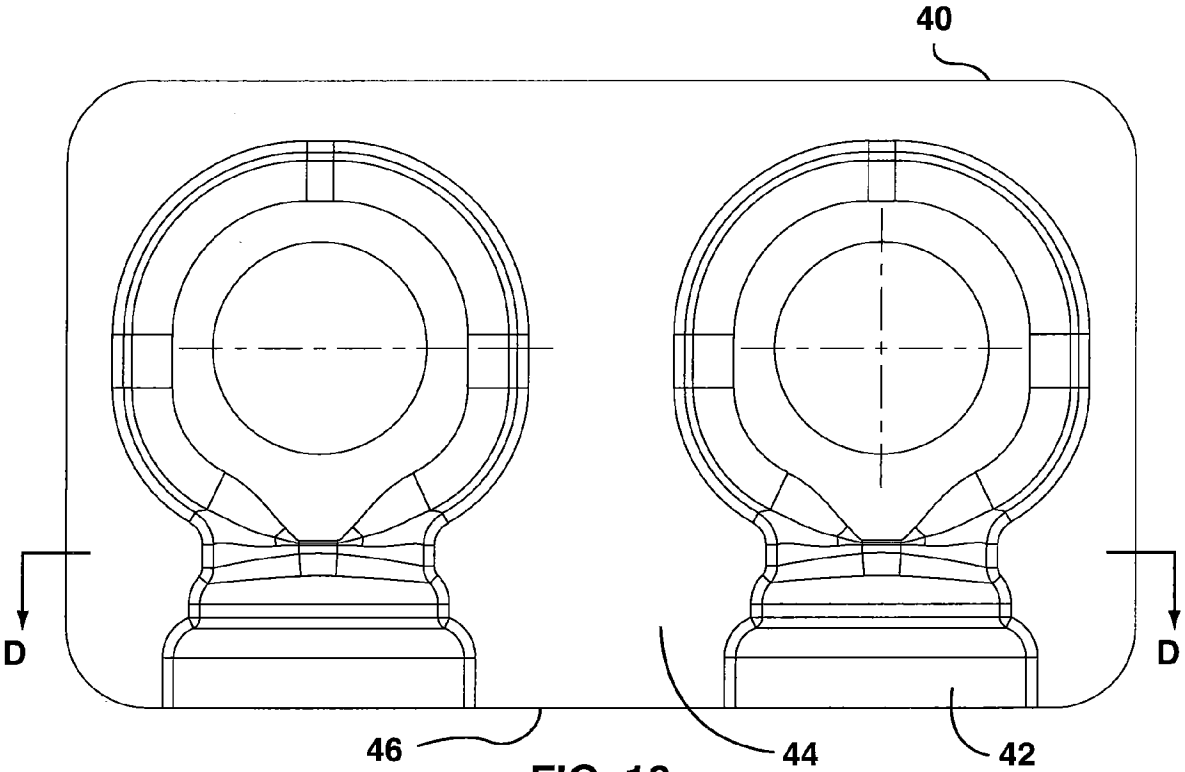
FIG. 18 shows a schematic of a top view of a portion of plate of a clamshell heat exchanger having side entry.
Figure 19:
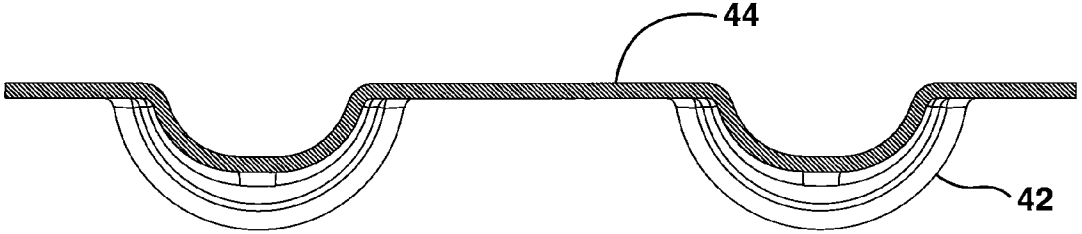
FIG. 19 shows a schematic of a side view of a portion of a plate of a clamshell heat exchanger having side entry, along the line D-D of FIG. 18.

FIGS. 18-20 show a portion of the plates of a clamshell heat exchanger having side entry. FIG. 18 shows the portion of the plates which form the plate pair (40) when placed in a in a face-to-face relationship. Each plate of the plate pair (40) has an indentation (42) formed from the edge of the plate (46). When the plates are brought together to form the plate pair (40), the indentations (42) align to form the conduit (22) which is adapted for receiving the fitting (2). In a particular embodiment, such as FIGS. 23 and 24, each plate of the pair having the indentation is identical to the other plate of the plate pair having the indentation. In the embodiment disclosed in FIGS. 18-20, a pair of indentations (42) is formed, where one of the indentations (42) is in fluid communication with the inlet and the other is in fluid communication with the outlet of the heat exchanger (38). Further, in one embodiment, as shown in FIGS. 23 and 24, the fitting (2) extends in a direction along the length of the heat exchanger (38).

Figure 21:
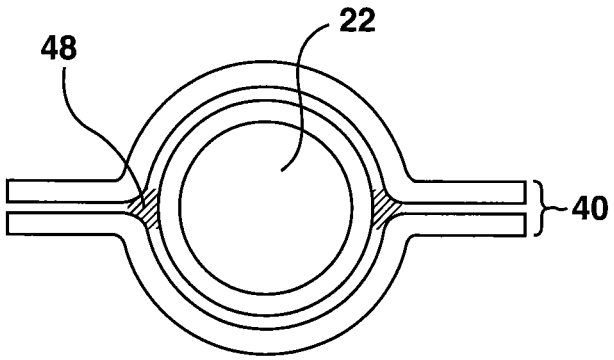
FIG. 21 shows a front view of an entry of a conduit of a clamshell heat exchanger.

In the embodiment disclosed in FIGS. 18-20, the indentation (42) formed is complementary to the fitting (2) having steps (26), as disclosed herein. This can help to ensure proper placement of the fitting (2) within the conduit (22) of the heat exchanger (38). Further, when the plate pair (40) is formed, a gap (48) (FIG. 21) can be present where the plate pair (40) meets and forms the conduit (22). The fittings (2) disclosed herein can also help to prevent leakage from such gaps (48).

Figure 22:
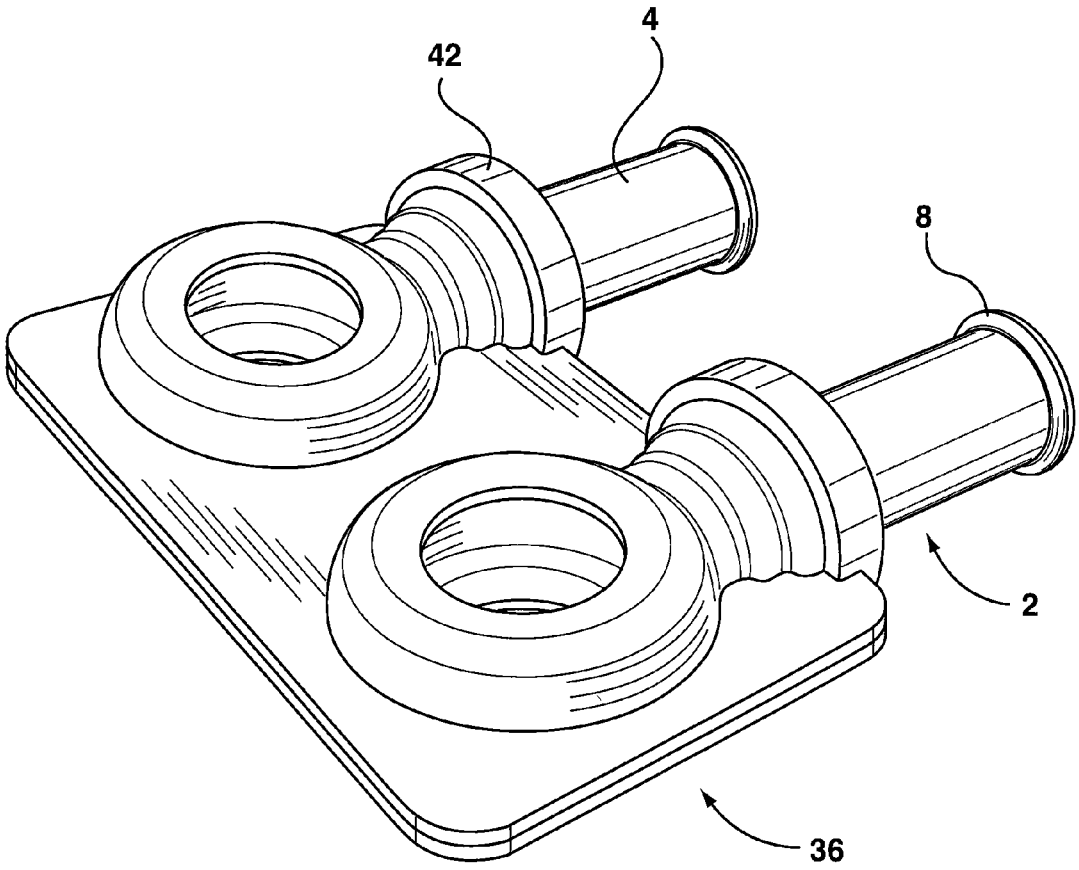
FIG. 22 shows a perspective view of a portion of a heat exchanger system according to a further aspect of the invention.
Figure 23:
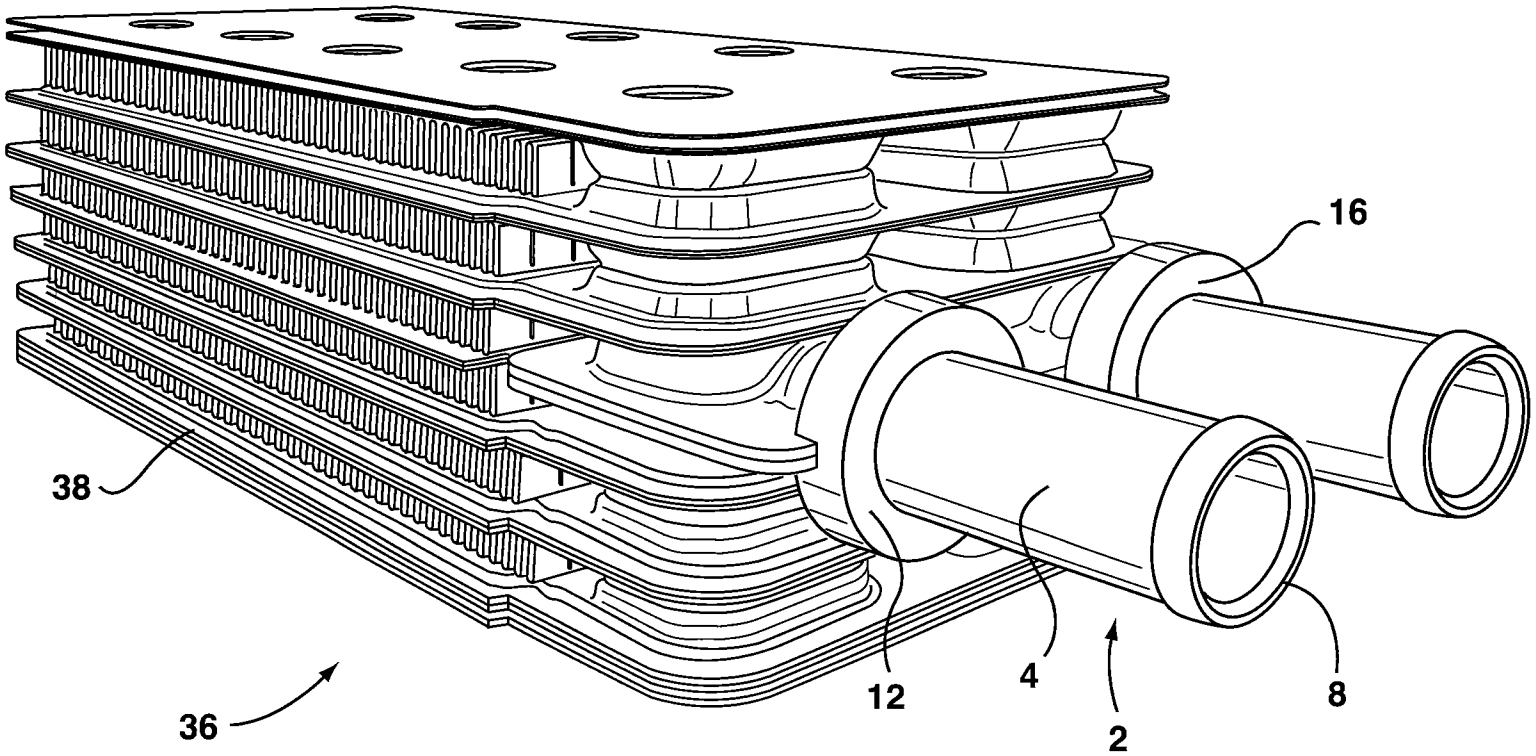
FIG. 23 shows a perspective view of a heat exchanger system according to a further aspect of the invention.
Figure 24:
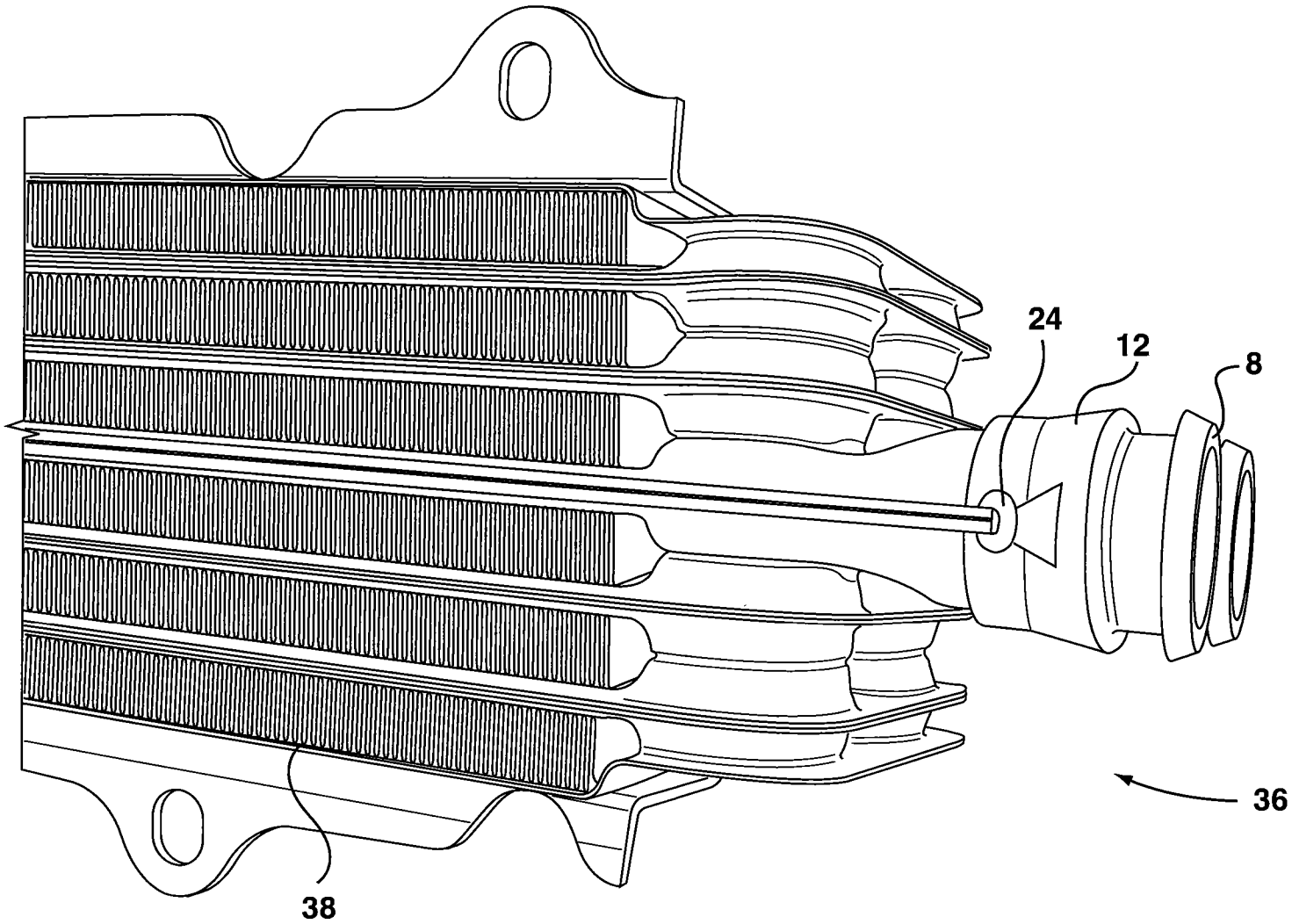
FIG. 24 shows a perspective view of a portion of another heat exchanger system according to a further aspect of the invention.

FIG. 22-24 show other embodiments of a heat exchanger system (36), in accordance with the specification. For forming the heat exchanger (38), the plate pair (40) having the conduit (22) can be formed and placed on a plate pair holder. The fitting (2), disclosed herein, can be attached to projections positioned on a movable fitting holder that can slide towards and away from the plate pair holder. Alignment means can be provided that can help to align the notches (24) on fitting (2) with the edges of the plate (46). The alignment means can also utilize the cut-out (56) provided on the fitting (2) for proper alignment of the fitting (2) with the plate pair (40). Upon proper alignment, the fitting holder can be moved towards the plate pair (40) for insertion of the heat exchanger attachment end (6) of the fitting (2) into the conduit (22), for coupling the fitting (2) to the heat exchanger (38).

The fitting (2) disclosed herein can help to prevent sagging and sliding out of the fitting (2) from the clamshell heat exchanger (38) without the need to modify the core plates (40), and while permitting only axial movement of the fitting (2). The fitting (2) can also remove the need to hold the clamshell plates (40) together while assembling and also helps to hold the plates (40) together while brazing. This can result in the fittings (2) from a side-entry being aligned and extending straight out from the plates (40). The fitting (2) can also allow a braze ring to be recessed in, for example, the space (20) or in the track (28), which can help with reducing assembly issues. Moreover, use of the fitting (4) can also help to remove the need to tox the plates together, and also help to reduce the use a flux paste for holding the plates (40) together during assembling.

Certain adaptations and modifications of the described embodiments can be made. Therefore, the above discussed embodiments are considered to be illustrative and not restrictive.

What is claimed is:

1. A heat exchanger system comprising:

a heat exchanger having a longitudinal spaced-apart plate pair, each plate of the plate pair being identical and having an indentation extending from a surface of the plate to an end of the plate for forming a conduit when the plates of the plate pair are positioned in a face-to-face relationship; the indentation forming the conduit having an edge that lies in the same plane as the end of the plate pair and an edge of the plate; and a fitting comprising:

a single tube having a heat exchanger attachment end and an opposing end;

a cylindrical sleeve having a sleeve body connecting a first end to a second end of the sleeve, the first end of the cylindrical sleeve being connected to an outer surface of the single tube, and the sleeve body and the second end of the cylindrical sleeve extending in a direction of the heat exchanger attachment end of the single tube and being spaced apart from the outer surface of the single tube defining a space for receiving the conduit for coupling the fitting to the conduit; and a notch at the second end of the cylindrical sleeve receiving the ends of the plate pairs, wherein the fitting extends in the longitudinal direction of the heat exchanger plate pair.

2. The heat exchanger system according to claim 1, wherein the second end of the sleeve is positioned adjacent to the outer surface of the tube proximate to the tube attachment end.

3. The heat exchanger system according to claim 1, further comprising a cut-out on the surface of the sleeve body that assists in alignment of the fitting with the heat exchanger.

4. The heat exchanger system according to claim 1, the sleeve comprising a wall wherein the wall extends from the stop surface.

5. The heat exchanger system according to claim 4, wherein the wall is perpendicular to the outer surface of the tube.

6. The heat exchanger system according to claim 5, wherein the tube and the wall are circular, and the wall contacts an outer edge of the conduit.

7. A system for heat exchange of a fluid, the system comprising:

a heat exchanger having a spaced-apart plate pair, each plate of the plate pair being identical and having an indentation extending from a surface of the plate to an end of the plate for forming a conduit when the plates of the plate pair are positioned in a face-to-face relationship; the indentation forming the conduit having an edge that lies in the same plane as the end of the plate pair and an edge of the plate; and a fitting comprising:

a single tube having a heat exchanger attachment end and an opposing end;

a cylindrical sleeve having a sleeve body connecting a first end to a second end of the cylindrical sleeve, the first end of the cylindrical sleeve being connected to an outer surface of the single tube, and the sleeve body and the second end of the cylindrical sleeve extending in a direction of the heat exchanger attachment end of the single tube and being spaced apart from the outer surface of the tube defining a space for receiving the conduit for coupling the fitting to the conduit;

and a notch at the second end of the cylindrical sleeve receiving the ends of the plate pairs.

* * * * *